US005434469A

United States Patent [19]

Cirri

[11] Patent Number: 5,434,469

[45] Date of Patent: Jul. 18, 1995

[54] ION GENERATOR WITH IONIZATION CHAMBER CONSTRUCTED FROM OR COATED WITH MATERIAL WITH A HIGH COEFFICIENT OF SECONDARY EMISSION

[75] Inventor: Gianfrancò Cirri, Florence, Italy

[73] Assignee: Proel Tecnologie S.P.A., Florence, Italy

[21] Appl. No.: 958,513

[22] Filed: Oct. 8, 1992

[30] Foreign Application Priority Data

Oct. 11, 1991 [IT] Italy ..... FI/91/A 248

[51] Int. Cl.[6] ..... H05H 1/24

[52] U.S. Cl. ..... 313/362.1; 313/359.1; 313/231.31; 313/103 R; 315/111.21; 315/111.81

[58] Field of Search ..... 313/359.1, 103 R, 103 CM, 313/105 R, 105 CM, 362.1, 231.01, 231.31; 315/511, 512, 111.01, 111.21, 111.71, 111.81

[56] References Cited

U.S. PATENT DOCUMENTS

| | | | |
|---|---|---|---|
| 3,634,690 | 1/1972 | Grant | 313/103 R |
| 4,298,817 | 11/1981 | Carette . | |
| 4,737,688 | 4/1988 | Collins . | |
| 4,859,908 | 8/1989 | Yoshida et al. | 313/359.1 |
| 5,241,243 | 8/1993 | Cirri . | |

FOREIGN PATENT DOCUMENTS

| | | |
|---|---|---|
| 0020899 | 1/1981 | European Pat. Off. . |
| 83 08138 | 11/1983 | France . |
| 59-151737 | 8/1984 | Japan . |
| 60-262333 | 12/1985 | Japan . |

*Primary Examiner*—Donald J. Yusko
*Assistant Examiner*—N. D. Patel
*Attorney, Agent, or Firm*—McGlew and Tuttle

[57] ABSTRACT

In a device for ion generation, the ionization chamber is characterized by walls coated with a material with a high coefficient of secondary emission, such as a suitable glass; this enables the energy yield and mass yield of the device to be improved with respect to known techniques. (FIG. 2)

6 Claims, 1 Drawing Sheet

State of the art

ION GENERATOR WITH IONIZATION CHAMBER CONSTRUCTED FROM OR COATED WITH MATERIAL WITH A HIGH COEFFICIENT OF SECONDARY EMISSION

FIELD OF THE INVENTION

The invention relates to a new design of an ionization chamber capable of being used advantageously in an ion generation device. In particular, but not exclusively, an ionization chamber according to the invention may be used in the field of space technology, for high energy and mass yields.

BACKGROUND OF THE INVENTION

Ion generation devices (also called ion generators, ion sources, ion guns, etc.) are in widespread use in the industrial field for surface treatments (ion etching, cleaning, deposition of materials, ion implantation, etc.) and chemical and physical analysis (for example, the determination of the type and orientation of crystals on the surface of a solid). In the space field such devices are used as ion engines and, on earth, for the generation of simulated ionospheric plasma.

A known device for the generation of ions is schematically shown in FIG. 1. This comprises an ionization chamber 1 and an extraction system 2. A substance in the gas or vapor state, from which the positive ions of the desired chemical type are obtained by various techniques known per se, is introduced into the ionization chamber. Such ions are then extracted from the ionization chamber, focused, and accelerated toward the lens of the extraction system 2. Other parts present in the device will not be mentioned here since they are not relevant to the description of the present invention. A plasma is generated in the ionization chamber, and contains positive ions which may be used for the formation of the ion beam, and free electrons which, when suitably accelerated, are capable of ionizing neutral atoms to produce other ions and free electrons. This process is maintained by a continuous supply of neutral atoms, as replacements for the extracted ions, together with electrical energy for the acceleration of the free electrons; the electrical energy is supplied by various techniques, the most common of which are continuous current discharge and radiofrequency or microwave discharge.

Among the most important factors determining the performance of ion generators are the energy yield, in other words the ratio between the energy of the ions in the beam and the energy expended to operate the device, and the mass yield, in other words the ratio between the mass of the ions extracted in the unit of time and the flow of introduced neutral atoms.

The energy yield is adversely affected by the energy required for the maintenance of the plasma in the ionization chamber, since this energy makes only an insignificant contribution to the final energy acquired by the ions in the accelerated beam.

The mass yield is adversely affected by the flow of neutral atoms leaving the device, which is also damaging because, next to the phenomenon of charge exchange in the proximity of the extraction system 2, it is the source of greatest erosion of the extraction system, but is particularly unfavourable to the use of the propellant.

An improvement of the mass yield generally entails a deterioration of the energy yield, since a higher rate of ionization is obtained only at the expense of a greater energy input, but this tends to favour the use of the propellant and therefore the autonomy of the device, which is particularly important in space applications.

In currently known devices, the walls of the ionization chamber consist of a metal, for example steel or molybdenum, or, if the walls have to be dielectric, quartz. The use of a dielectric material is necessary in cases in which the excitation of the plasma in the ionization chamber takes place with a transfer of radio-frequency energy through electrodes or coils external to the ionization chamber. In all the cited cases, the losses of electrons on the walls of the ionization chamber constitute an important factor limiting the performance of the device.

It has now been discovered (and this forms the basis of the invention) that it is possible to improve both of the mentioned yields by modifying the characteristics of the walls of the ionization chamber. In fact, the ions and electrons colliding with the walls may be subject to recombination phenomena, and consequently a cancellation of their electrical charge, with a probability which is particularly high if the walls are electrically conducting, but which is also not insignificant even if these walls consist of dielectric material.

SUMMARY AND OBJECTS OF THE INVENTION

The subject of the present invention is an ionization chamber having walls consisting of or coated by a special material, to obtain a number of advantages over the known techniques, as will be clearly understood by experts in the field from a reading of the following text.

A subject of the invention is therefore an ionization chamber which has its walls facing the discharge, and those of its internal electrodes, constructed from or coated with a material with a high coefficient of secondary emission.

In an advantageous embodiment, the surfaces consist of glass.

Certain substances, such as bismuth, lead, cesium, or others, may be added to the glass composition to optimize its coefficient of thermal expansion, thermal conductivity, electrical conductivity and other physical and/or chemical and/or mechanical properties, in relation to the device and to the conditions in which the chamber is to operate.

According to one embodiment, an ionization chamber may have internal surfaces coated with a material, for example cesium, bismuth or lead, capable of increasing their coefficient of secondary emission.

A further subject of the invention is an ion generator which comprises an ionization chamber as defined above.

The invention will be more clearly understood from an examination of the description and the attached drawing, which shows a practical non-restrictive example of the invention. In the drawing, FIG. 1 is a diagram of a conventional solution, already described; and FIG. 2 is a diagram of an example of a device according to the invention.

DETAILED DESCRIPTION OF THE PREFERRED EMBODIMENT

Figure 1:
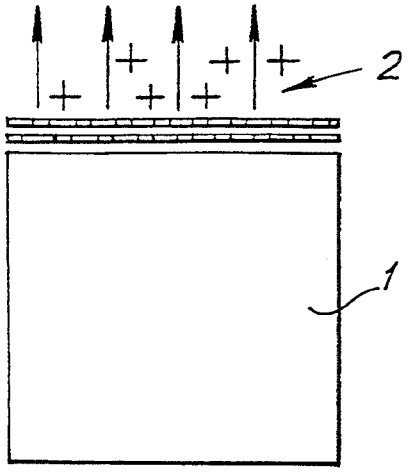

It has been found from theory and experimental data in the field of electron multipliers that when an electron having an energy V collides with the surface of a material having a high coefficient of secondary emission (for example, glass) at an angle of Θ with respect to the perpendicular, the mean number of secondary electrons emitted is equal to:

$$\delta = \delta m(0)\left[\frac{V}{Vm(0)}\sqrt{\cos}\,\Theta\right]^{\beta}\exp\left\{\alpha(1-\cos\Theta)+\beta\left[1-\frac{V}{Vm(0)}\sqrt{\cos}\,\Theta\right]\right\}$$

where vm(O) is the energy which makes δ maximum when Θ=O. In the case of glass, Vm(O) lies between 300 and 400 eV;

δm(O) is the maximum value of δ for Θ=0. In the case of glass, δm(O) is approximately 3;

α is a material constant whose value is about 0.62 for glass;

β is a parameter which lies between 0.55 and 0.65 for glass, if V≦Vm(O) (as is generally true of ion generators).

It may be seen from the formula above that, even in cases in which the energy of the free electrons is lowest, for example of the order of 15 eV, as found when xenon gas is to be ionized, the value of δ for normal incidence is approximately 0.8. This value is even higher if the energy of the incident electrons is higher, up to a maximum of approximately 3 for V=Vm(O).

The use of a dielectric material having a high coefficient of secondary emission may offer considerable and unforeseeable advantages if used for the walls of the ionization chamber of an ion generator, resulting in low electron losses at the walls, since each electron colliding with the walls, instead of being lost, causes a mean emission of a number δ of secondary electrons which may be used to continue the ionization process. Consequently in the final analysis the energy and mass yields of the ion generator are increased.

In an advantageous embodiment, the present invention consists of an ionization chamber having glass walls. According to the description above, the glass is advantageous by comparison not only with metals, but also with quartz, having a higher coefficient of secondary emission and a lower coefficient of recombination (expressing the probability that ions and electrons will recombine on its surface) than these materials.

It is also possible to add small quantities of other substances (usually metals or metal oxides) to the composition of the glass, thus modifying as desired some of its physical properties such as the coefficient of thermal expansion, the thermal conductivity and the electrical conductivity; in particular, substances such as bismuth, lead, and others are suitable. By coating the surface of the glass with a thin layer of suitable material, for example cesium, a considerable increase in the coefficient of secondary emission is then obtained.

It is evident, therefore, that the use of glass offers the designer of ion generators a much greater flexibility and range of choices than the use of conventional materials, and therefore enables devices with better performance and lower cost to be produced.

Figure 2:
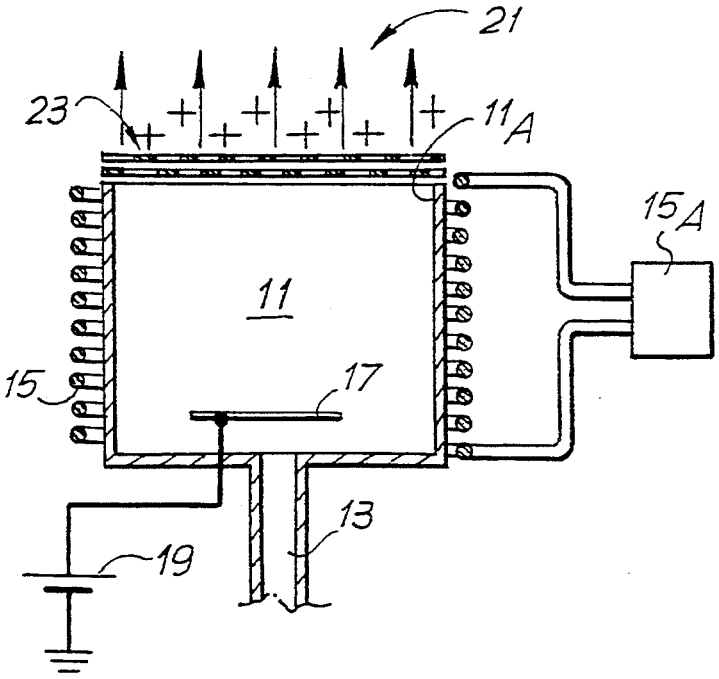

According to the invention and according to the example shown in schematic longitudinal section in FIG. 2, the ionization chamber, indicated in a general way by 11, has walls 11A made of glass or coated with glass on the side of the discharge chamber, the glass or equivalent being of a type suitable as regards the physical, chemical and mechanical characteristics. These walls may be internally coated with cesium or other material capable of increasing their coefficient of secondary emission, and the glass may incorporate lead, bismuth or other substances. The chamber 11 receives a gas to be ionized through a suitable gas inlet line 13. A device to transfer electrical energy into the interior of the chamber (plasma generating means) is located around the ionization chamber and is shown schematically in the example as a coil 15 supplied from a radiofrequency generator 15A. A metal element 17, also coated with a material with a high coefficient of secondary emission and electrically connected to a continuous voltage generator 19, maintains the plasma in the ionization chamber at the desired electrical potential, in such a way as to supply energy to the beam of ions 21, which is extracted, focused and accelerated by the extraction system ion extraction means 23. The shape of said metal element 17 may be flat and enlarged where it faces the outlet of the line 13, and may have holes in order to act as a diffuser to make the flow of gas uniform in the ionization chamber; said element may also be in wire form in order to limit as much as possible the metal surface exposed to the plasma and the losses associated with this, although it is coated with a material with a high coefficient of secondary emission.

It is to be understood that the drawing shows only an example provided solely as a practical demonstration of the invention, this invention being variable in its forms and dispositions without thereby departing from the scope of the invention.

I claim:

1. An ion generator, comprising:

an ionization chamber with a wall delimiting said ionization chamber, said wall having an inner surface facing said ionization chamber and an outer surface;

a gas supply line, connected to said ionization chamber, for supplying a gas into said ionization chamber;

plasma generating means for generating a plasma from said gas supplied to said ionization chamber, said plasma containing ions and electrons;

ion extraction means for accelerating and extracting ions from said ionization chamber;

wherein said wall delimiting said ionization chamber is made of glass, said glass being doped with a substance chosen from bismuth, lead cesium, or a combination thereof, said wall not being electrically connected to said plasma generating means and not being connected to a voltage source.

2. An ion generator according to claim 1 wherein the inner surface of said wall is coated with a substance chosen from bismuth, lead, cesium or a combination thereof.

3. An ion generator, comprising:

an ionization chamber with a wall delimiting said ionization chamber, said wall having an inner surface facing said ionization chamber and an outer surface;

a gas supply line, connected to said chamber, for supplying a gas into said ionization chamber;

plasma generating means for generating a plasma from said gas supplied to said ionization chamber, said plasma containing ions and electrons;

ion extraction means to accelerate and extract ions from said plasma generated in said ionization chamber;

wherein said inner surface of said wall delimiting said ionization chamber is coated with glass, said glass being doped with a substance chosen from bismuth, lead, cesium or a combination thereof, said wall being not electrically connected to said plasma generating means and not being connected to a voltage source.

4. An ion generator according to claim 2, wherein said inner surface is also coated with a substance chosen from bismuth, lead, cesium or a combination thereof.

5. An ion generator, comprising:

means defining an ionization chamber including walls delimiting said ionization chamber, said walls having an inner surface facing said ionization chamber and an outer surface, said inner surface being coated with a substance chosen from the group consisting of bismuth, lead, cesium and a combination of two or more of bismuth, lead and cesium, said walls also being coated with a glass, said walls being passive, not connected to a voltage source;

a gas supply line connected to said means defining an ionization chamber for supplying a gas into said ionization chamber;

plasma generating means for generating a plasma from said gas supplied to said ionization chamber, said plasma generating means including a voltage source not electrically connected to said walls of said means defining an ionization chamber and ion means for accelerating ions from said plasma generated from gas supplied to said ionization chamber and for extracting ions from said plasma.

6. An ion generator according to claim 5, wherein said glass is doped with a substance chosen from the group consisting of bismuth, lead, cesium or a combination of two or more of bismuth, lead and cesium.

* * * * *